US009327524B1

(12) United States Patent
Yamada et al.

(10) Patent No.: US 9,327,524 B1
(45) Date of Patent: May 3, 2016

(54) DRYER AND INKJET IMAGE FORMING APPARATUS

(71) Applicants: Masafumi Yamada, Kanagawa (JP); Takuma Nakamura, Kanagawa (JP); Tetsurou Sasamoto, Kanagawa (JP)

(72) Inventors: Masafumi Yamada, Kanagawa (JP); Takuma Nakamura, Kanagawa (JP); Tetsurou Sasamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/940,384

(22) Filed: Nov. 13, 2015

(30) Foreign Application Priority Data

Dec. 17, 2014 (JP) ..... 2014-255534

(51) Int. Cl.
*B41J 11/00* (2006.01)

(52) U.S. Cl.
CPC ..... *B41J 11/002* (2013.01); *B41J 11/0005* (2013.01)

(58) Field of Classification Search
CPC ..... B41J 11/0005; B41J 11/002; B41J 2/14; B41J 2/04; B41J 2/06; C09D 11/52; C09D 11/30
See application file for complete search history.

(56) References Cited

U.S. PATENT DOCUMENTS 7,677,715 B2 * 3/2010 Uji et al. ..... B41J 11/0005 106/31.27

FOREIGN PATENT DOCUMENTS

| | | |
|---|---|---|
| JP | 6-278271 | 10/1994 |
| JP | 7-195683 | 8/1995 |
| JP | 2001-150784 | 6/2001 |
| JP | 2004-276551 | 10/2004 |
| JP | 2010-197535 | 9/2010 |
| JP | 2015-003489 | 1/2015 |
| JP | 2015-074136 | 4/2015 |
| JP | 2015-129902 | 7/2015 |

* cited by examiner

*Primary Examiner* — Thinh Nguyen
(74) *Attorney, Agent, or Firm* — Oblon, McClelland, Maier & Neustadt, L.L.P

(57) ABSTRACT

A dryer for drying an ink image formed on a recording medium is provided. The dryer includes a selective heating dryer, a uniform heating dryer, and a controller. The selective heating dryer is disposed on an upstream side of a feeding path of the recording medium, and performs a first-time drying of the ink image under an output condition in which an amount of cockling becomes equal to or less than a given amount. The uniform heating dryer is disposed on a downstream side from the selective heating dryer on the feeding path, and performs a second-time drying of the ink image after the selective heating dryer performs the first-time drying. The controller changes the output condition of the selective heating dryer in accordance with image information of the ink image, when the ink image is formed with a conductive-particle-containing ink.

6 Claims, 15 Drawing Sheets

DRYER AND INKJET IMAGE FORMING APPARATUS

CROSS-REFERENCE TO RELATED APPLICATIONS

This patent application is based on and claims priority pursuant to 35 U.S.C. §119(a) to Japanese Patent Application No. 2014-255534, filed on Dec. 17, 2014, in the Japan Patent Office, the entire disclosure of which is hereby incorporated by reference herein.

BACKGROUND

1. Technical Field

The present disclosure relates to a dryer and an inkjet image forming apparatus.

2. Description of the Related Art

There is a growing need for small-lot multiproduct printing, for printing direct mails for individuals, etc., in recent years. Commercial offset printer is for large-lot printing and using a printing plate. Such an offset printer becomes more advantageous in cost performance and efficiency as the number of print copies increases. However, offset printer is unsuitable for variable printing such as small-lot multiproduct printing. For variable printing, on-demand printing using no plate is suitable. High-speed on-demand printers employing electrophotography is now spreading.

Another example of the on-demand printing includes inkjet printing. Since inkjet printing system is simpler than electrophotography, compact and budget personal inkjet printer is in widespread use. However, high-speed inkjet printer has not been actively developed in view of reliability of ink nozzle and printing speed.

Recently, the development of line head has advanced. Since line head does not require main scanning of ink nozzle, it is now possible to develop high-speed inkjet printer. Accordingly, there is a strong possibility that high-definition inkjet printer with a simple configuration is developed as on-demand high-speed printer.

Inkjet printer has some problems in a drying process. Low-speed printers for personal use have a problem of paper swelling caused due to moisture in ink. However, this problem is not fatal and can be solved by means of natural drying of the paper. With respect to high-speed printers, this problem cannot be solved by natural drying. When the printed copies are stacked, undesired phenomena such as offset, blocking, and color omission may occur.

Thus, the drying process cannot be eliminated from the inkjet printing process. As the drying process, drum drying that heats a drum, radiation drying that irradiates a target by a halogen lamp or infrared heater, and hot-air drying that blows hot air to a target have been employed. The drying process in inkjet printing corresponds to the fixing process in electrophotography. Therefore, the drying process damages one merit of inkjet technology, i.e., low energy consumption. Thus, it is required that the amount of energy consumed in the drying process is as small as possible.

The object to be dried is only ink. If other parts, such as paper or roller, are heated, energy is consumed unnecessarily. To selectively dry ink, means using frictional loss of dipole of dielectric body may be used, such as microwave and high-frequency wave dielectric heating. In this case, the calorific value depends on dielectric constant and loss tangent of the dielectric body. These values for water are extremely high. Accordingly, with respect to a medium on which an image is formed with an ink, the medium is not heated and only moisture in the ink is heated. Since only the amount of heat used for heating results in power loss in a high-frequency electric field, it is overwhelmingly advantageous in energy efficiency.

Microwave band is greater than high-frequency wave band in terms of loss tangent of water. Thus, microwave band is more advantageous for high-energy-density heating. However, there are some problems such as radio wave leakage and uneven heating. When a printer configured to successively take in/out a recording medium employs a dryer using microwave, the configuration may become complicated and the cost may increase. By contrast, high-frequency dielectric dryer is simpler in configuration, and has been widely used for print dryer.

Inkjet printing also has a problem of cockling. Cockling is a phenomenon in which paper having an ink image thereon swells by moisture in the ink and becomes undulate. In a case where a solid patch image is formed on paper, the solid image part is swollen by the ink but the peripheral non-image part is not. Cockling is caused due to a difference in the degree of swelling generated at an interface of the image. Actually, cockling starts growing upon impact of an ink droplet on paper, and the amount of cockling becomes maximum several tens of seconds later. The order of the amount of cockling corresponds to the time scale of permeation and swelling of paper fiber. The amount of cockling thereafter decreases by natural drying, however, does not become zero. This is because strain, which has been generated due to swelling of paper, is still remaining. With respect to high-quality printing such as offset printing, even a slight amount of cockling may degrade the image quality. Accordingly, how to suppress the occurrence of cockling is one object for inkjet printing that is one of high-quality printing technologies.

One additional problem is caused when a conductive-particle-containing ink, such as a black ink containing carbon black particles, is used. As conductive particles for black inks, carbon black is superior in terms of density, texture, and color development and is widely used. An ink dispersing carbon black particles exhibits no conductivity. As carbon black particles in a black solid image come into contact with each other as drying of the image progresses, the image exhibits conductivity in a direction of the plane thereof. High-frequency dielectric heater, which is one type of heaters heating a dielectric body, may cause dielectric heating or spark, if a conductive body exists, depending on the resistance value of the conductive body.

Thus, when a solid image formed with a black ink containing carbon black is heated by a high-frequency dielectric heater, abnormal heating may occur and the image may get burned as drying of the image progresses. In this case, since the black image gets burned before other inks containing no conductive particle are completely dried, the drying process cannot be conducted at all.

SUMMARY

In accordance with some embodiments of the present invention, a dryer for drying an ink image formed on a recording medium is provided. The dryer includes a selective heating dryer, a uniform heating dryer, and a controller. The selective heating dryer is disposed on an upstream side of a feeding path of the recording medium, and performs a first-time drying of the ink image under an output condition in which an amount of cockling becomes equal to or less than a given amount. The uniform heating dryer is disposed on a downstream side from the selective heating dryer on the feeding path, and performs a second-time drying of the ink image after the selective heating dryer performs the first-time drying. The controller changes the output condition of the selective heating dryer in accordance with image information of the ink image, when the ink image is formed with a conductive-particle-containing ink.

In accordance with some embodiments of the present invention, an inkjet image forming apparatus is provided. The inkjet image forming apparatus includes an inkjet head that discharges an ink on a recording medium, and the above dryer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
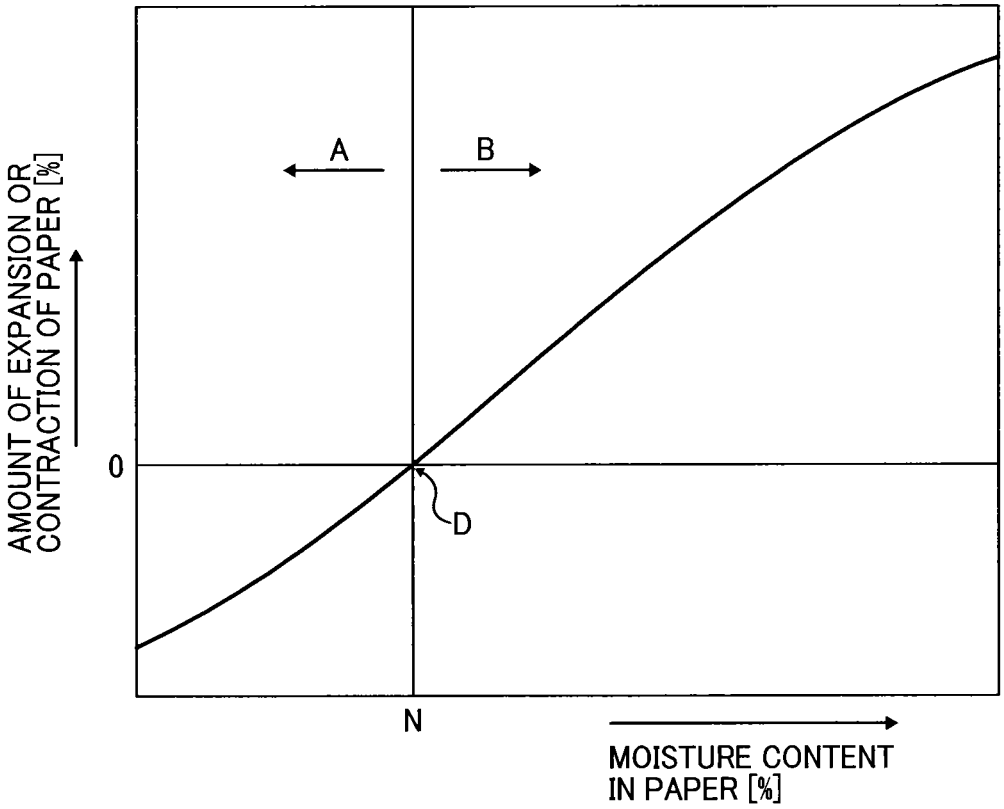
FIG. 1 is a diagram showing a relation between moisture content in paper and the amount of expansion or contraction of paper.

The accompanying drawings are intended to depict example embodiments of the present invention and should not be interpreted to limit the scope thereof. The accompanying drawings are not to be considered as drawn to scale unless explicitly noted.

DETAILED DESCRIPTION

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

In view of the above-described situation, one object of the present invention is to provide a dryer which can perform reliable drying while suppressing the occurrence of cockling regardless of external conditions and preventing a conductive-particle-containing ink image from scorching.

In accordance with some embodiments of the invention, a dryer which can perform reliable drying while suppressing the occurrence of cockling regardless of external conditions and preventing a conductive-particle-containing ink image from scorching is provided.

A mechanism of cockling is described below. Cockling is a phenomenon in which a paper medium (hereinafter simply "paper"), serving as a recording medium, having an ink image thereon swells due to moisture in the ink and becomes undulate. A solid image part is swollen by the ink but the peripheral non-image part is not. Cockling is caused due to a difference in the degree of swelling generated at an interface of the image.

FIG. 1 is a diagram showing a relation between moisture content in paper and the amount of expansion or contraction of paper. In FIG. 1, the moisture content (%) in paper is on the lateral axis, and the amount of expansion or contraction (%) of paper is on the vertical axis. In FIG. 1, N is a perpendicular line of the lateral axis, and the foot thereof represents a moisture content in paper under natural condition. On left and right sides of the line N, a contraction region A and a swelling region B are defined, respectively. D is an intersection of the line N and a curve showing moisture content in paper, and represents a condition in which the amount of expansion or contraction of paper is zero (0%) under natural condition.

Actually, paper starts swelling upon impact of an ink droplet thereon, and the swelling amount becomes maximum several tens of seconds later. Here in FIG. 1, the amount of expansion or contraction stands for the maximum swelling amount. As moisture in the ink permeates paper fiber to divide hydrogen bonds in the paper fiber, the paper generates swelling. Thus, the greater the moisture content in paper, the more the paper expands. Under natural condition, paper has a moisture content corresponding to atmospheric humidity. However, when the paper is forcibly dried, the moisture content in the paper decreases to cause contraction of the paper.

It is clear from FIG. 1 that as the amount of ink increases, the amount of swelling of paper and the amount of cockling also increase.

Figure 2A:
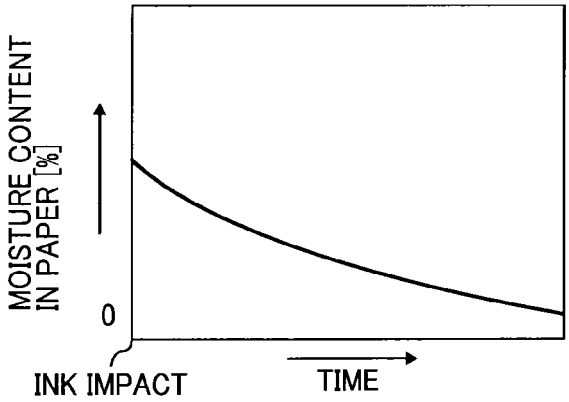
FIG. 2A is a graph showing a time variation of moisture content in paper under natural drying.
Figure 2B:
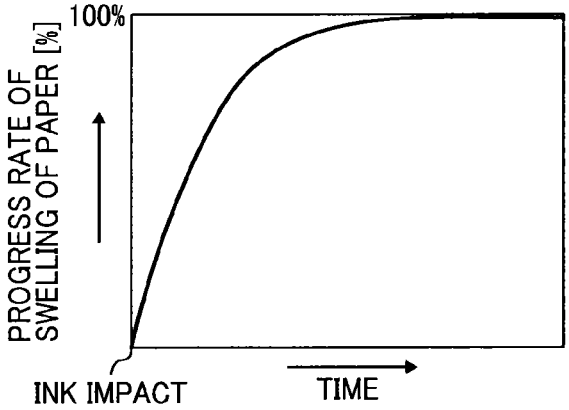
FIG. 2B is a graph showing a time variation of the progress rate of swelling of the paper after an ink impact.
Figure 2C:
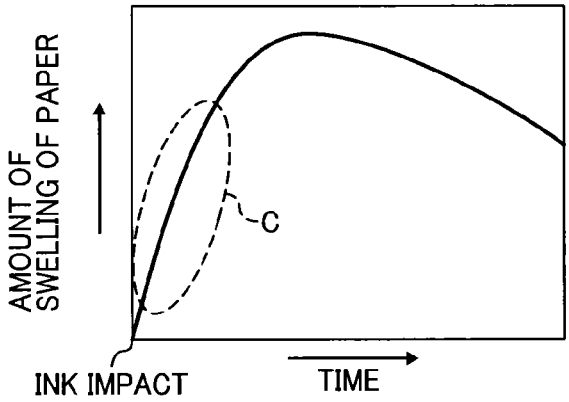
FIG. 2C is a graph showing a time variation of the amount of expansion or contraction of the paper after the ink impact.

FIG. 2A is a graph showing a time variation of moisture content in paper under natural drying, FIG. 2B is a graph showing a time variation of the progress rate of swelling of the paper after an ink impact, and FIG. 2C is a graph showing a time variation of the amount of expansion or contraction of the paper after the ink impact. In FIGS. 2A to 2C, time variation is on the lateral axis. In FIG. 2A, the moisture content (%) in paper is on the vertical axis. In FIG. 2B, the progress rate (%) of swelling of the paper is on the vertical axis. In FIG. 2C, the amount of expansion or contraction of the paper is on the vertical axis.

Referring to FIG. 2A, the moisture content in paper becomes maximum immediately after an ink impact and gradually decreases with time due to natural drying. On the other hand, referring to FIG. 2B, it takes a certain period of time until the paper is swollen after the ink impact. The product of FIG. 2A and FIG. 2B indicates actual time variation of swelling of the paper, which is shown in FIG. 2C.

According to the above-described mechanism, the swelling of paper should be canceled at the end of natural drying. However, the swelling of paper is not completely canceled in actual. The reason for this is considered that strain, which has been generated by dividing hydrogen bonds between paper fibers at generation of the swelling of paper, is still remaining. Accordingly, in the case where the paper has experienced the condition in which the swelling amount of paper becomes maximum as shown in FIG. 2C, the residual strain also becomes larger. When the paper is subject to drying at the earliest possible timing, as indicated by a region C encircled with dashed line in FIG. 2C, the paper needs not swell in large amounts. In this case, the residual strain can be reduced and the quality of the output image after being dried can be improved. Thus, rapid drying is preferable.

Figure 3:
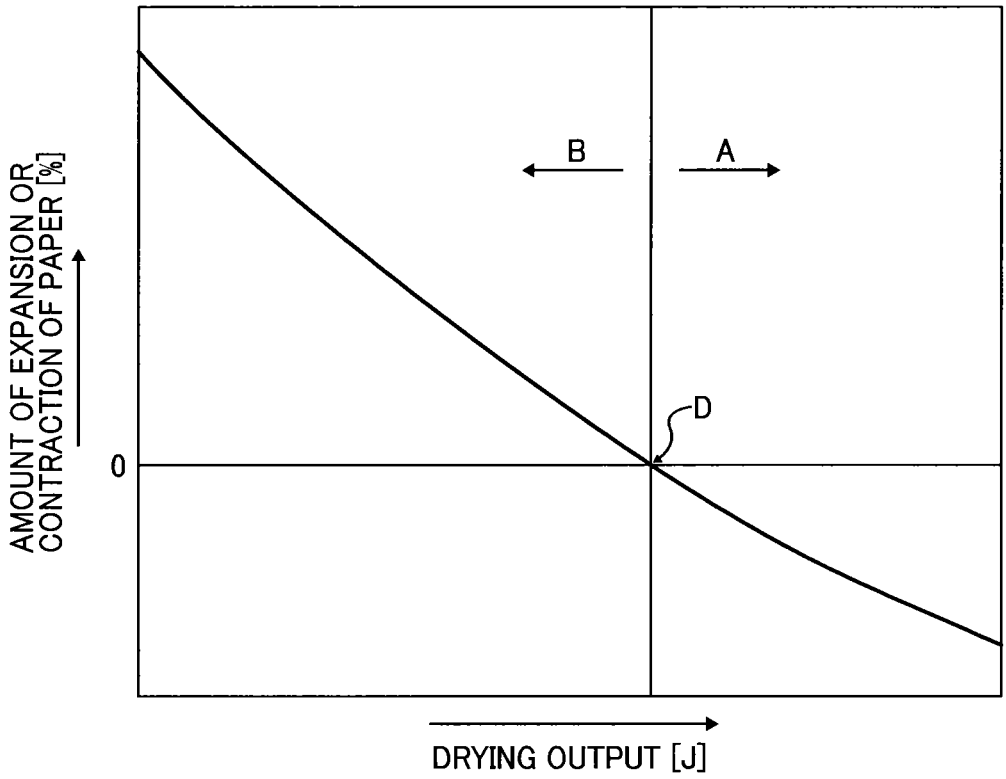
FIG. 3 is a diagram showing a relation between drying output (J) in forcibly drying paper having an ink image thereon and the amount of expansion or contraction (%) of the paper.

A method of suppressing cockling by means of forced drying is described below with reference to FIG. 3. FIG. 3 is a diagram showing a relation between drying output (J) in forcibly drying paper having an ink image thereon and the amount of expansion or contraction (%) of the paper.

As shown in FIG. 3, as the drying output increases, the paper more contracts rather than expands. This is because, as is clear from FIG. 1, the moisture in the ink evaporates in accordance with the drying output. Accordingly, it is possible to suppress the paper from expanding or contracting by setting the drying output properly, i.e., in such a manner that the amount of expansion or contraction of the paper becomes zero, as indicated by the intersection D in FIG. 3.

Figure 4A:
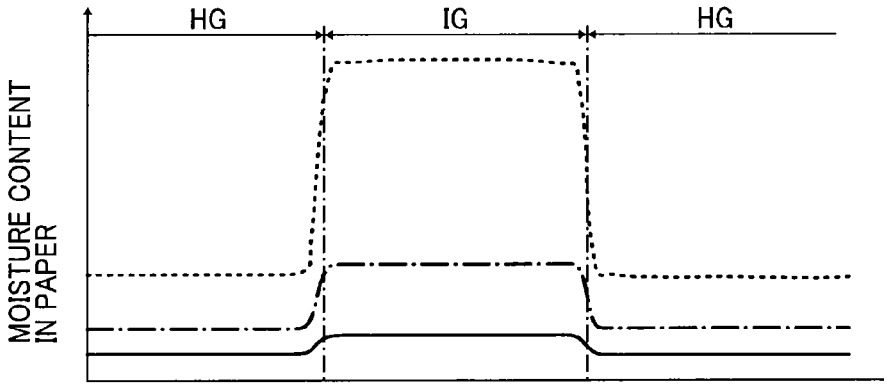
FIGS. 4A to 4C are diagrams showing variations in moisture content in paper when the paper is dried by a uniform heater, a dielectric heater, and a combination of the uniform heater and the dielectric heater, respectively.
Figure 4B:
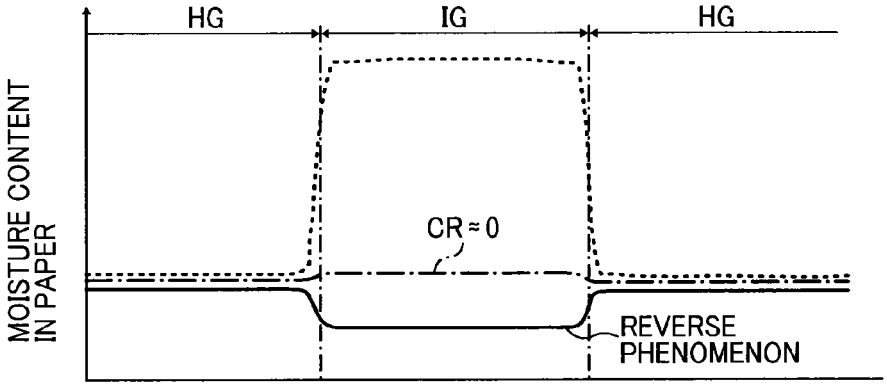
Figure 4C:
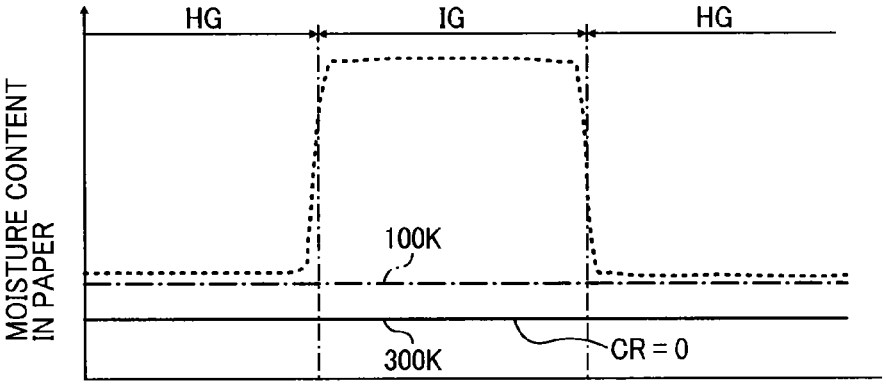

FIGS. 4A to 4C are diagrams showing variations in moisture content in paper when the paper is dried by a uniform heater, a dielectric heater, and a combination of the uniform heater and the dielectric heater, respectively. In FIGS. 4A to 4C, HG and IG respectively represent a non-image part and an ink image part. In FIGS. 4A and 4B, short dashed lines represent variations in moisture content in paper immediately after printing, dot-and-dash lines represent variations in moisture content in paper under a drying condition in which the amount of expansion or contraction of the ink image part IG becomes zero, and solid lines represent variations in moisture content in paper when an additional drying energy is applied. In FIG. 4C, a short dashed line represents a variation in moisture content in paper immediately after printing, a dot-and-dash line represents a variation in moisture content in paper after a drying is performed by the dielectric heater, and a solid line represents a variation in moisture content in paper after a complete drying is performed by the uniform heater.

The uniform heater, which is one of conventional heating means such as hot-air heater, heat drum, or wideband infrared (IR) radiation heater represented by ceramic heating resistor, is supposed to uniformly heat the entire paper medium. In this case, as shown in FIG. 4A, even when the amount of expansion or contraction of the ink image part IG becomes zero, the moisture content in the non-image part HG also decreases. As a result, the difference in moisture content between the ink image part IG and the non-image part HG becomes smaller but never becomes zero. Therefore, the amount of cockling cannot completely become zero.

On the other hand, the dielectric heater, which is represented by heating means such as microwave heater and high-frequency (1 to 100 MHz) dielectric heater, can solve the above-described problem, since the dielectric heater is a selective heater capable of selecting an object to be heated. The dielectric heater generates heat by means of frictional heat caused by molecule vibration of a dielectric body. Therefore, calorific property of the dielectric heater depends on the property of substance.

Heat generation in the dielectric heater is represented by the following formula (1).

$$P=0.556\times10^{-10}\times f\times E^2\times\in_r\times\tan\delta(W/m^3) \quad (1)$$

wherein P ($W/m^3$) represents a calorific value per unit volume, f represents a frequency (Hz), E represents an electric field intensity (V/m), $\in_r$ represents a relative permittivity, and tan δ represents a dielectric loss tangent.

In the formula (1), $\in_r$ and tan δ vary depending on the type of substance. Water can easily generate heat because of having remarkably high $\in_r$ and tan δ values. In particular, water containing additives such as ion has greater $\in_r$ and tan δ values than pure water. This is a reason why the ink is easily heatable. By contrast, cellulose that is paper fiber composing paper generates little heat since a slight amount of moisture contained therein generates heat only slightly.

Therefore, only the ink image part IG is heated, and the non-image part HG is heated very little. As a result, the difference in moisture content between the ink image part IG and the non-image part HG becomes zero as shown in FIG. 4B. As the output of the dielectric heater further increases, the reverse phenomenon occurs in which the ink image part IG more contracts than the non-image part HG does to cause cockling on the non-image part HG. This indicates that it is possible to properly control the drying output of the dielectric heater to make the amount of cockling approximately equal to zero (CR≈0).

On the other hand, inkjet ink generally contains solvents such as glycerin. Many of the solvents have a boiling point higher than that of water. Therefore, solvents will remain in the ink without being dried even when moisture has been evaporated therefrom. The remaining solvents may cause undesired phenomena such as offset and blocking. The occurrence of such phenomena indicates that the drying is insufficient.

To completely remove solvents from the ink, a larger amount of energy is required compared to a case of completely removing moisture from the ink. If only the dielectric heater is used to meet this requirement, the ink image part IG more contracts than the non-image part HG does, as shown in FIG. 4B, to cause cockling on the non-image part HG.

Figure 5:
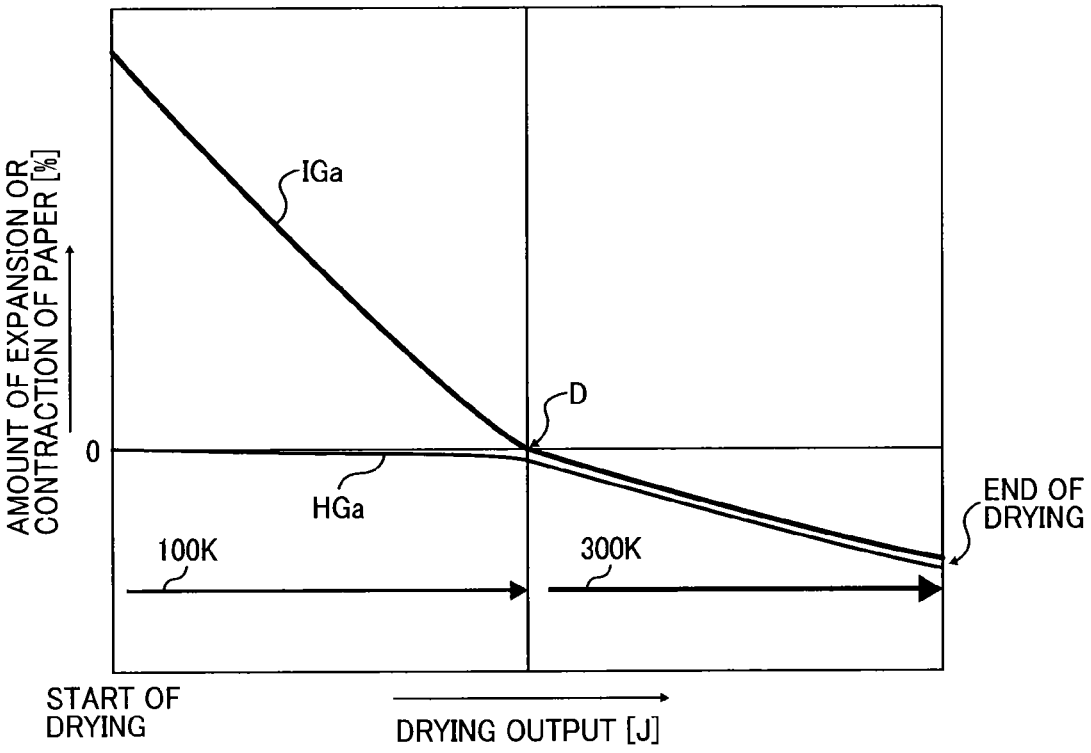
FIG. 5 is a diagram showing a relation between drying output and the amount of expansion or contraction of paper when a dielectric heater and a uniform heater are used in combination.

For the above reasons, the dielectric heater and the uniform heater are combined to perform a complete drying, in other words, to make the amount of cockling zero (CR=0), as shown in FIG. 4C and FIG. 5. In FIG. 5, 100K and 300K represent the drying output ranges by the dielectric heater and the uniform heater, respectively. A thick line IGa and a thin line HGa represent the amounts of expansion or contraction of the ink image part IG and the non-image part HG, respectively.

First, the dielectric heater provides an optimum drying output so that the difference in the amount of expansion or contraction between the ink image part IG and the non-image part HG becomes zero without causing cockling. Subsequently, the uniform heater provides an output until the solvents have been completely removed while maintaining the difference in the amount of expansion or contraction between the ink image part IG and the non-image part HG zero.

Details of a conductive-particle-containing ink are described below with reference to FIGS. 6A and 6B. The conductive-particle-containing ink may be a black ink containing carbon black particles 20. Carbon black is very advantageous in terms of black image quality and cost, and is widely used for inkjet inks and printing inks. The carbon black particles 20 are conductive bodies.

Figure 6A:
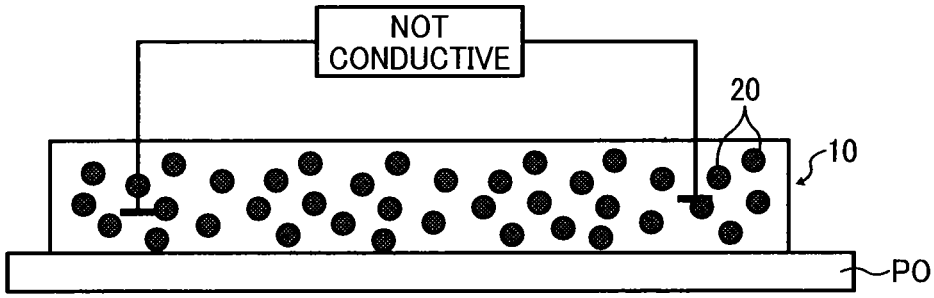
FIG. 6A is a schematic cross-sectional view of an ink layer in which carbon black particles are dispersed and which has not been dried.

As shown in FIG. 6A, the carbon black particles 20 exhibit no conductivity when dispersed in an ink layer 10 which has not been dried. This is because the carbon black particles 20 are not conductive from a macro-scale perspective, although they are conductive bodies from a micro-scale perspective. By contrast, as shown in FIG. 6B, the carbon black particles 20 exhibit conductivity when brought into contact with each other as drying of the ink layer 10 progresses. In particular, when the ink layer 10 is forming a solid image, the entire solid image becomes conductive. If the ink layer 10 in the state of FIG. 6B is heated by a high-frequency dielectric heater, abnormal heating will occur. This is because dielectric heating and/or spark will occur due to the existence of the conductive bodies. On the other hand, a solid image which is formed with a black ink on paper having good permeability may not cause abnormal heating even when heated by a high-frequency dielectric heater. This indicates that micro-conductivity of the carbon black particles 20 does not contribute to abnormal heating. Accordingly, only macro-conductivity should be taken into consideration.

Figure 6B:
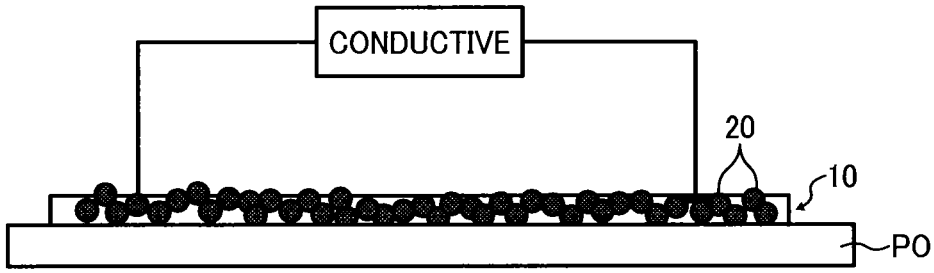
FIG. 6B is a schematic cross-sectional view of an ink layer in which carbon black particles are dispersed and which has been dried.

Referring back to the case in which the ink layer 10 is formed on a paper medium PO having a low permeability, the carbon black particles 20 gradually come to exhibit conductivity as drying of the ink layer 10 progresses from the state illustrated in FIG. 6A to the state illustrated in FIG. 6B, thus increasing a likelihood of the occurrence of abnormal heating. As shown in FIG. 5, cockling least likely occurs in a state in which moisture in the ink has been almost dried but solvents are still remaining. In that state, moisture has almost disappeared, and carbon black particles have been brought into contact with each other to exhibit macro-conductivity. As a result, abnormal heating may occur to cause scorch and/or ignition.

Figure 7:
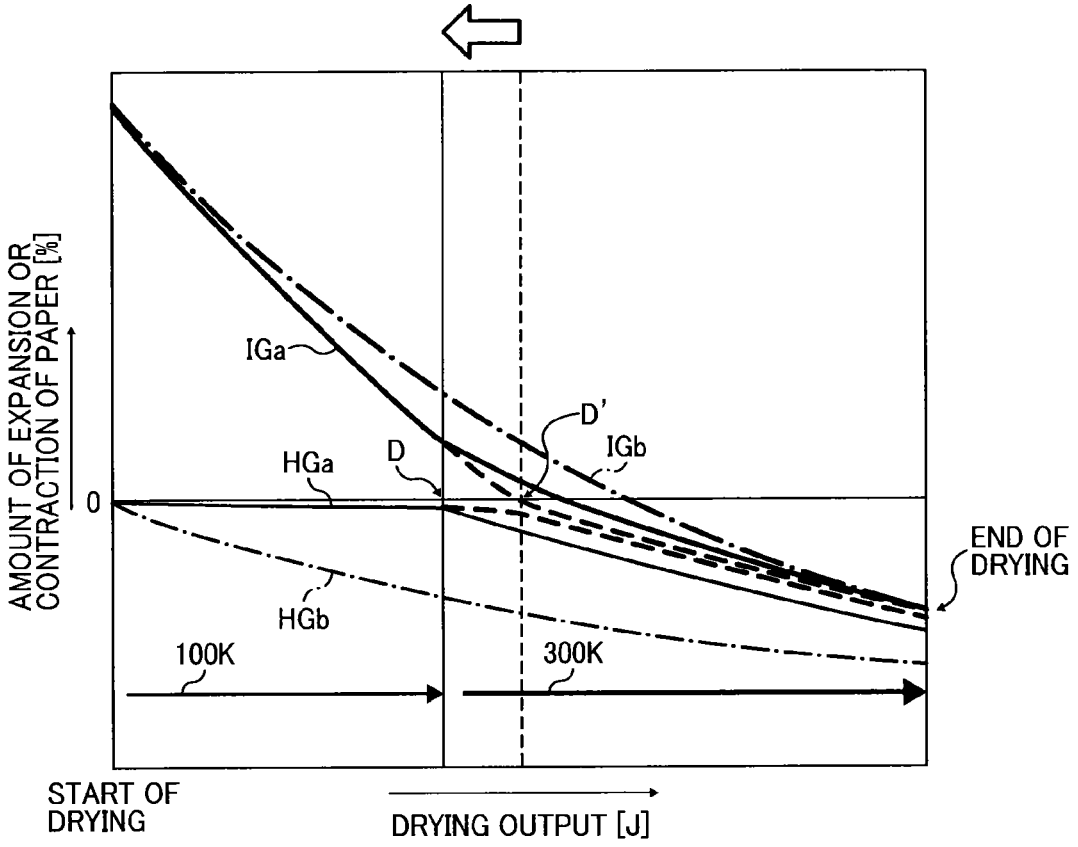
FIG. 7 is a diagram showing a relation between drying output and the amount of expansion or contraction of paper when a dielectric heater and a uniform heater are used in combination and a black ink is used.

To prevent the occurrence of abnormal heating when the black ink is in use, as shown in FIG. 7, a drying should be performed by the dielectric heater with a drying output corresponding to D, which is lower than a drying output corresponding to D' where the amount of cockling becomes minimum. In this case, although the optimum amount of cockling cannot be controlled, the amount of cockling can be reduced compared to a case in which only the uniform heater is used.

In FIG. 7, a thick solid line IGa represents the amount of expansion or contraction of the ink image part IG, and a thick dot-and-dash line IGb represents the amount of expansion or contraction of the ink image part IG when only the uniform heater is used. A thin solid line HGa represents the amount of expansion or contraction of the non-image part HG, and a thin dot-and-dash line HGb represents the amount of expansion or contraction of the non-image part HG when only the uniform heater is used.

Figure 8:
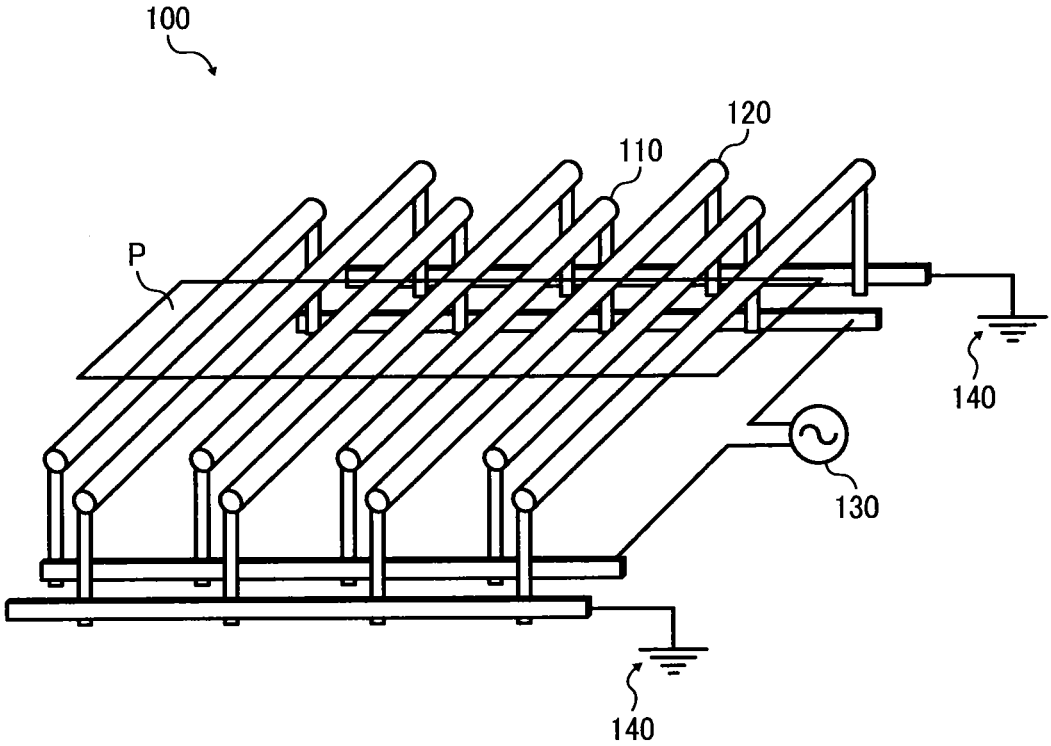
FIG. 8 is a perspective view of a dielectric heater using high-frequency electrodes.

The configuration of the dielectric heater, serving as a selective heating dryer, is described below with reference to FIG. 8. FIG. 8 is a perspective view of a dielectric heater 100 using high-frequency electrodes. Since the dielectric heater 100 has an opening for taking in/out a paper medium P having ink image thereon to be dried/has been dried, a high-frequency wave having a frequency of 1 to 100 MHz is more frequently used than microwave, in view of leakage of radio wave from the opening. Within the above-specified frequency range, around 13.56 MHz, 27.12 MHz, and 40.68 MHz are assigned as ISM (Industry-Science-Medical) bands. Therefore, the dielectric heater 100 uses one of these ISM bands. Additionally, a dielectric heater using high-frequency wave is more advantageous in view of unevenness in heating. On the other hand, microwave is more advantageous in terms of power density.

The dielectric heater 100 includes rod-like electrodes 110 to be applied with a high-frequency voltage, rod-like electrodes 120 to be grounded, and a high-frequency power source 130. Each of the multiple rod-like electrodes 110 and each of the rod-like electrodes 120 are alternately arranged to form a grid electrode. Both ends of each of the rod-like electrodes 110 are connected to the high-frequency power source 130 to be applied with a high-frequency voltage. Both ends of each of the rod-like electrodes 120 are grounded on a ground 140. The dielectric heater 100 is a constitutional element of a dryer 600 to be described later with reference to FIG. 12.

Figure 9:
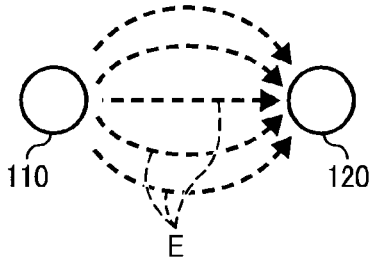
FIG. 9 is a schematic view illustrating an electric field formed between rod-like electrodes in the dielectric heater illustrated in FIG. 8.
Figure 10:
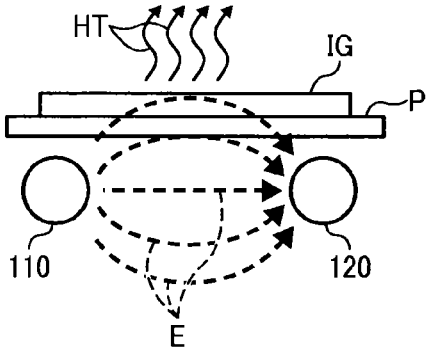
FIG. 10 is a schematic view illustrating a state in which an ink image formed on a paper medium is generating heat in the electric field formed between rod-like electrodes in the dielectric heater illustrated in FIG. 8.

Upon application of a predetermined voltage from the high-frequency power source 130 to the rod-like electrodes 110, as shown in FIG. 9, an electric field E is formed between the rod-like electrodes 110 and 120 adjacent to each other. As shown in FIG. 10, as the paper medium P having an ink image IG thereon is put in the electric field E, the ink image IG is mainly heated, and the ink image IG on the paper medium P generates heat HT.

The ground electrode parts (the rod-like electrodes 120) may be applied with a high-frequency voltage having a 180°-inversed phase relative to the high-frequency voltage applied to the application electrode parts (the rod-like electrodes 110). The configuration of the electrode is not limited to that of the grid electrode illustrated in FIG. 8 so long as an electric field can be generated. However, in the case of drying a thin sheet-like material, such a grid electrode is generally used because such a material is most effectively dried as being conveyed along the grid electrode.

Since the electric field intensity increases toward the grid electrode, it is preferable that the paper medium P is subjected to heating or drying while being brought as close as possible to the grid electrode. The intensity of the electric field E gets strongest at the middle point between the rod-like electrodes 110 and 120 adjacent to each other, as shown by HK in FIG. 11, and weakest at a position immediately above each of the rod-like electrodes 110 and 120. Accordingly, when the paper medium P is stopped, heating unevenness is generated between the middle point between the rod-like electrodes 110 and 120, and the position immediately above each of the rod-like electrodes 110 and 120, as shown by HM in FIG. 11.

Figure 11:
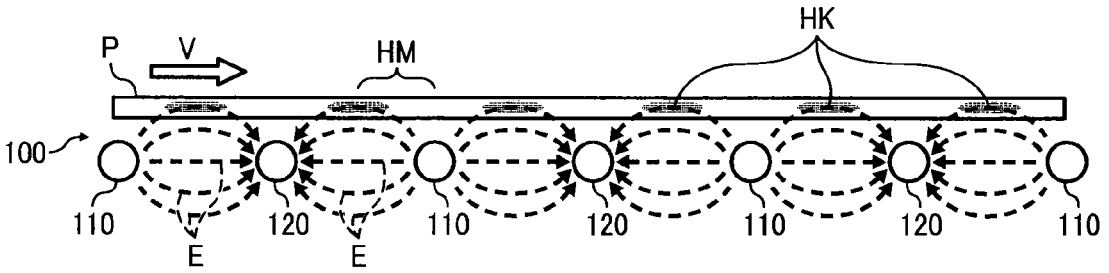
FIG. 11 is a schematic view illustrating a heat distribution in a grid electrode.

By contrast, when the paper medium P is moving in a direction indicated by arrow in FIG. 11 at a constant speed V along the grid electrode, no heating unevenness HM is generated over the entire paper medium P. By making the interval between the rod-like electrodes 110 and 120 constant, the electric field intensity between the rod-like electrodes 110 and 120 is also made constant. Thus, the grid electrode on the whole can sufficiently prevent the occurrence of uneven heating.

Figure 12:
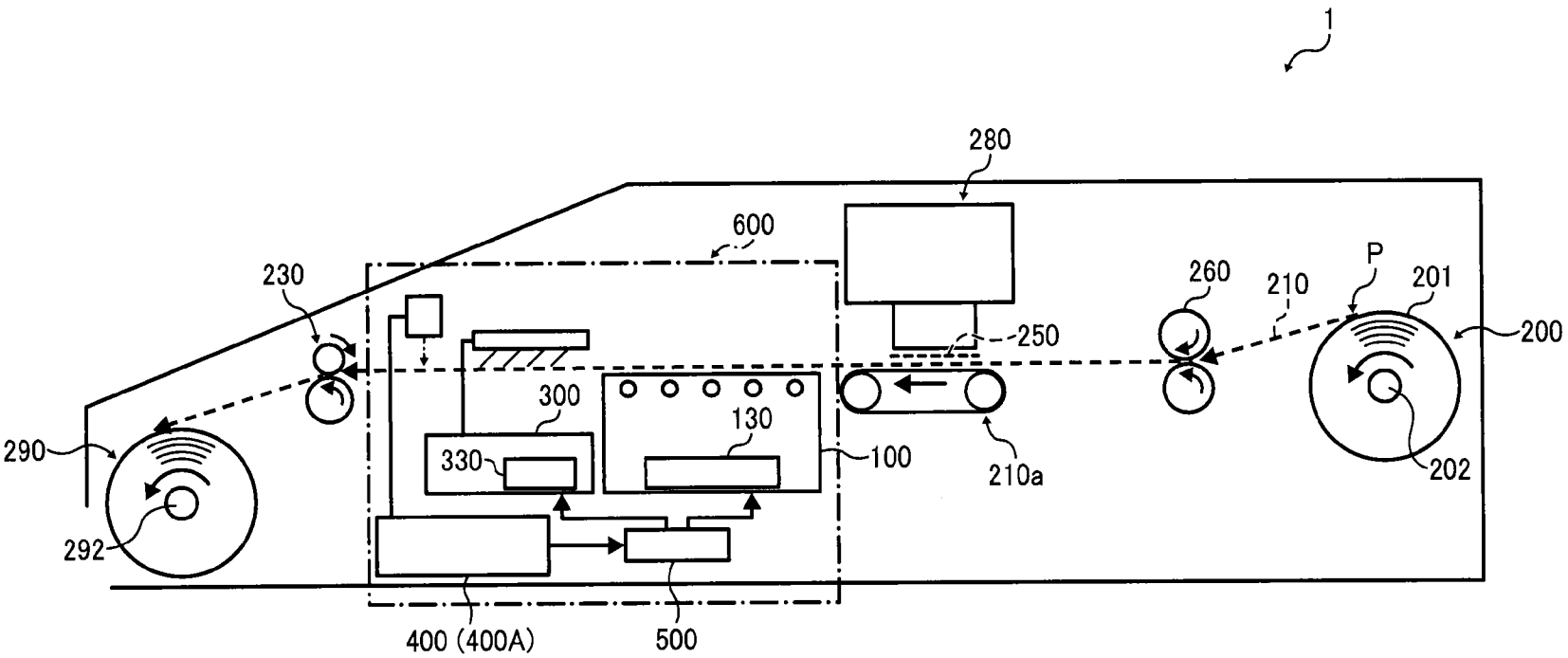
FIG. 12 is a schematic view of an inkjet image forming apparatus including a dryer in accordance with an embodiment of the present invention.

An inkjet image forming apparatus 1 including a dryer 600 having the above-described drying mechanism is described below with reference to FIG. 12. FIG. 12 is a schematic view of an inkjet image forming apparatus 1 including a dryer 600 in accordance with an embodiment of the present invention.

The inkjet image forming apparatus 1 includes a recording medium storage 200, a medium feeding path 210, a medium feeding roller pair 260, a medium feeding mechanism 210*a*, an inkjet head 280, the dryer 600, an ejection roller 230, and a recording medium winder 290. In the recording medium storage 200, a support shaft 202 is arranged for supporting a rolled paper 201. The rolled paper 201 is formed by rolling up an elongated paper medium P, and the paper medium P is deliverable from the rolled paper 201. The paper medium P is supplied as being delivered from the rolled sheet 201.

The inkjet head 280 is disposed on a downstream side of the medium feeding path 210. The medium feeding path 210 is for feeding the recording medium stored in the recording medium storage 200. The inkjet head 280 may be of either: a carriage type that moves or scans in a width direction of the paper medium; or a line head type that discharges ink without scanning in a width direction of the paper medium. In particular, since a drying mechanism is required by a high-speed machine which rolls up prints formed by a line head at high speeds, the line head type should be mainly considered. Since the line-head-type inkjet printer is capable of feeding the paper medium P at a constant speed, only the linear speed thereof should be considered when determining drying conditions. Specific examples of the inkjet image forming apparatus 1 include a production printer generally used by entities having large printing demands. The production printer is a high-speed printer used for mass printing (e.g., 100 sheets or more per minute).

In the case in which the recording medium is a sheet film made of a resin, since it takes a very long time to dry prints formed on such a sheet film, a drying mechanism is required even by the carriage-type-head printer.

The dryer 600 includes the above-described drying mechanism including the dielectric heater 100 serving as a selective heating dryer, a uniform heater 300 serving as a uniform heating dryer, a cockling condition detector 400, and a controller 500. The dielectric heater 100 is disposed on a downstream side from the inkjet head 280 on the medium feeding path 210. The uniform heater 300 is disposed on a downstream side from the dielectric heater 100 on the medium feeding path 210. The cockling condition detector 400 is disposed on a downstream side from the uniform heater 300 on the medium feeding path 210. The dryer 600 combines the dielectric heater 100 and the uniform heater 300 to make the amount of cockling zero and to perform a complete drying at the same time.

The uniform heater 300 may employ conventional heating means such as hot-air heating, heat drum, or wideband infrared (IR) radiation heating represented by ceramic heating resistor. Specific examples the heat source for the heat drum include halogen heater and nichrome-wire heater. The uniform heater 300 has a power source 330 to supply electric energy to at least one of the above-described heat sources.

IR radiation heating may cause heating unevenness depending on the color of ink, when the wavelength band range is narrow. This is because the light absorption spectrum differs depending on the color of ink. When the wavelength band range is wide, heating unevenness is absorbed and approximately uniform heating can be achieved. In terms of energy efficiency, IR radiation heating is most efficient. Hot-air drying is not so efficient because it requires the air be heated and part of the airflow is not used for drying. Heat drum is very low in efficiency because it requires the drum be heated and heat is transmittable only when the paper medium is in intimate contact with the drum. Both hot-air drying and heat drum are inferior to high-frequency dielectric heating in terms of efficiency. In the present embodiment, an initial drying is performed by means of high-frequency dielectric heating to suppress the occurrence of cockling while saving a large amount of energy.

The cockling condition detector 400 has a function of detecting the cockling condition of the paper medium P. The cockling condition detector 400 is disposed on a downstream side from the uniform heater 300 on the medium feeding path 210. The cockling condition detector 400 may employ various types of sensors such as a line-laser-type non-contact displacement sensor 400A and a paper humidity sensor.

Figure 13A:
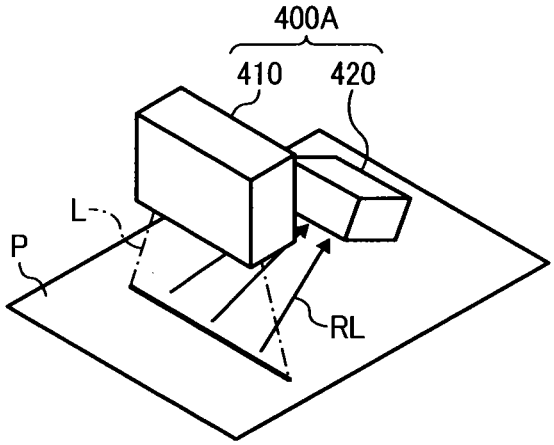
FIGS. 13A and 13B are perspective views of a line-laser-type non-contact displacement sensor in accordance with an embodiment of the present invention.

The line-laser-type non-contact displacement sensor 400A, as an embodiment of the cockling condition detector 400, is described in detail below with reference to FIGS. 13A and 13B. FIGS. 13A and 13B are perspective views of the line-laser-type non-contact displacement sensor 400A in accordance with an embodiment of the present invention.

The line-laser-type non-contact displacement sensor 400A includes a laser light emitting element 410 to emit laser light L to the paper medium P and a CCD sensor 420 to read reflected light RL from the paper medium P. The CCD sensor 420 including a charge-coupled device (CCD) is just an illustrative example and may be replaced with, for example, a complementary metal oxide semiconductive device (CMOS). In the present embodiment, a CCD is used as a line sensor for reading the reflected light RL.

The CCD sensor 420 is disposed apart from the laser light emitting element 410 a predetermined distance and slanted relative to the paper medium P by a predetermined angle. The CCD sensor 420 reads a profile of the laser light L emitted to the paper medium P. As the laser light L having a line-like profile is emitted from the laser light emitting element 410 to the paper medium P, the CCD sensor 420 reads and recognizes the reflected light RL.

Figure 13C:
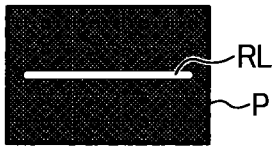
FIGS. 13C and 13D are images read by the CCD sensor of the line-laser-type non-contact displacement sensor.
Figure 13B:
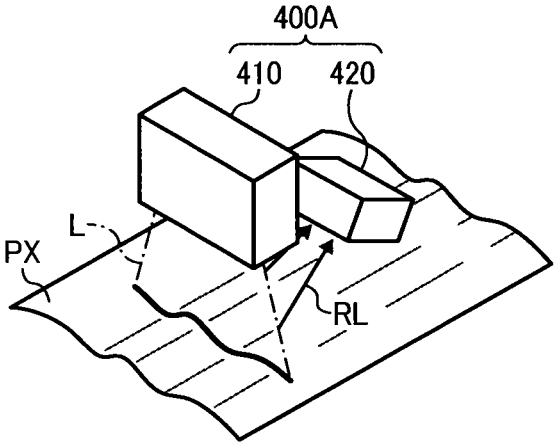
Figure 13D:
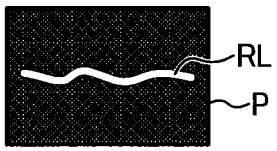

Specifically, as shown in FIG. 13A, in the case where the paper medium P is in the form of a flat plane, the CCD sensor 420 recognizes the reflected light RL as a straight line corresponding to the plane of the paper medium P, as shown in an image read by the CCD sensor 420 illustrated in FIG. 13C. In the case where the paper medium P has irregularity, the CCD sensor 420 recognizes the reflected light RL as a curve corresponding to the irregularity of the paper medium P, as shown in an image read by the CCD sensor 420 illustrated in FIG. 13D. Thus, the amount of cockling occurred on the paper medium P can be detected. Although being generally expensive, the line-laser-type non-contact displacement sensor 400A is capable of directly detecting the amount of cockling with a high degree of accuracy.

In addition, a paper humidity sensor, such as a sensor described in JP-5212167-B, the disclosure thereof being incorporated herein by reference, may also be used as the cockling condition detector 400. This sensor includes a compact heater, a compact thermometer, and a hygrometer, and detects moisture content in paper based on information from these components. This is one example of MEMS technology (Micro Electro Mechanical System technology: one of micro-fabrication technologies based on integrated circuit processing technologies) which contributes to downsizing and low cost. Moreover, an infrared moisture meter, such as an instrument JE-700 available from Kett Electric Laboratory, may be used as the cockling condition detector 400, which causes a slight increase in cost. Humidity of paper and the amount of cockling have a correlation shown in FIG. 1. Therefore, it is possible to specify a humidity of paper at which the amount of cockling becomes minimum, and to hold the specified value in a table (i.e., to memorize the specified value in a read only memory (ROM) in the controller 500, to be described later) as a target value.

The controller 500 has a basic function of changing (or correcting) an output condition of the high-frequency power source 130 in the dielectric heater 100 in accordance with image information of an ink image, when the ink image is formed with a conductive-particle-containing ink.

The controller 500 also has a function of decreasing an output of the high-frequency power source 130 in the dielectric heater 100 and increasing an output of the power source 330 in the uniform heater 300 to adjust a drying output through the entire drying process, when the ink image includes an image pattern formed with the conductive-particle-containing ink.

The controller 500 also has a function of causing the dielectric heater 100 to dry an ink image having a solid pattern formed with an ink not containing conductive particle on the paper medium P, and correlating an output of the high-frequency power source 130 in the dielectric heater 100 with a detection result from the cockling condition detector 400, during an initial adjustment process and a regular adjustment process in an operation the dryer 600, to determine the output condition of the high-frequency power source 130 in which the amount of cockling becomes equal to or less than a given amount (or becomes minimum).

The controller 500 includes a microcomputer including a central processing unit (CPU), an input-output (I/O) port, a read only memory (ROM), a programmable read only memory (PROM), and a timer, which are connected to each other through a signal bus. Programs for exhibiting the operation and control functions of the CPU and related data (e.g., the correlation data shown in FIG. 1) are memorized in the ROM and PROM in advance.

An operation of the inkjet image forming apparatus 1 is described below with reference to FIG. 12. The rolled paper 201 held by the recording medium storage 200 is sequentially delivered as the paper medium P as the medium feeding roller pair 260 rotates. The paper medium P is further fed to a recording part 250 of the inkjet head 280 disposed on a downstream side of the medium feeding path 210. At this time, the ejection roller 230 and the recording medium winder 290, both disposed on downstream sides, start rotating. On the lower side of nozzles of the inkjet head 280, the medium feeding mechanism 210*a* called platen is disposed. The medium feeding mechanism 210*a* guides and feeds the paper medium P with a micro gap formed between the nozzles and the paper medium P maintained. On the paper medium P being fed by the medium feeding mechanism 210*a* while maintaining a planer form thereof, inks of multiple colors are sequentially discharged from multiples nozzles of the inkjet head 280. Thus, a desired ink image is formed on the paper medium P.

After the formation of the ink image, the paper medium P swelled by the ink image is subjected to a drying operation in the dryer 600 so that cockling is removed. The paper medium P is then fed by the ejection roller 230 and wound up by a winding shaft 292 of the recording medium winder 290.

Details of the black ink image and abnormal heating are described below. As described above, when carbon black particles included in a black ink are brought into contact with each other to exhibit macro-conductivity, abnormal heating more likely occurs. As the thickness of the black ink layer becomes larger, the macro-conductivity becomes higher. Thus, as the image density becomes higher, the conductivity becomes higher, and abnormal heating more likely occurs.

Figure 14:
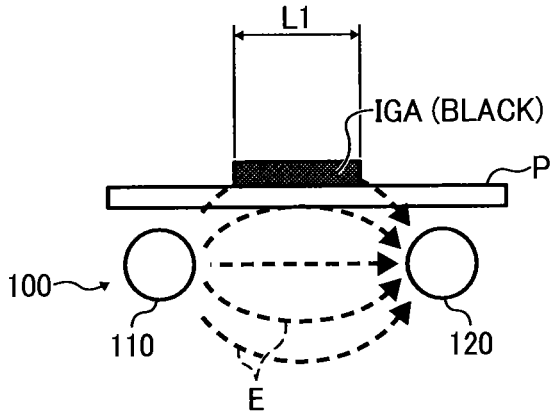
FIG. 14 is an illustration for explaining the length of a large black solid image in the dielectric heater illustrated in FIG. 8.
Figure 15:
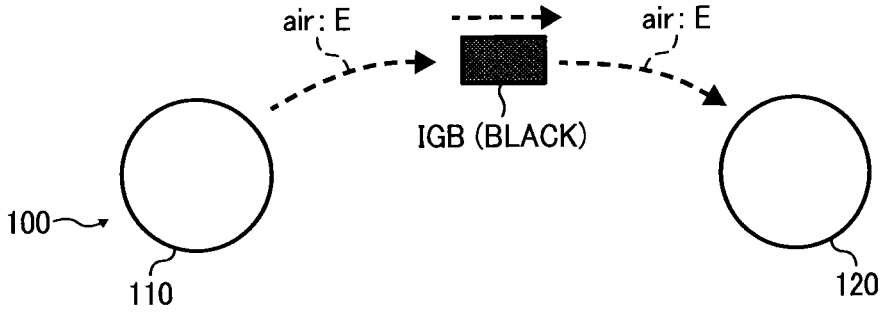
FIG. 15 is an illustration for explaining an electric field applied to a small black ink image in the direction of arrangement of the rod-like electrodes in the dielectric heater illustrated in FIG. 8.

Since carbon black particles less likely generate heat when being dispersed, the likelihood of occurrence of abnormal heating also depends on the size of the image. Specifically, abnormal heating less likely occurs in dot patterns while more likely occurs in large solid image patterns. Referring to FIG. 14, in the dielectric heater 100, the electric field E is applied to an ink image IGA that is a black solid pattern (hereinafter "black solid image IGA") formed on the paper medium P. The direction of the electric field E is coincident with the direction of arrangement of the rod-like electrodes 110 and 120. Therefore, the likelihood of occurrence of abnormal heating depends on the length L1 of the black solid image IGA. In FIGS. 14 and 15, IGA and IGB represent ink images that are black solid patterns having large and small sizes, respectively.

Even when the length of the black solid image is greater than the distance between the rod-like electrodes 110 and 120, the electric field applied thereto and the conductivity thereof do not change. Therefore, the likelihood of occurrence of abnormal heating also does not change. In other words, such a black solid image having a width greater than the distance between the rod-like electrodes 110 and 120 is equivalent in terms of the likelihood of occurrence of abnormal heating.

On the other hand, referring to FIG. 15, in the case of the ink image IGB that is a black solid pattern (hereinafter "black solid image IGB") having a width is smaller than the distance between the rod-like electrodes 110 and 120, a spaces is formed between the black solid image IGB and each of the rod-like electrodes 110 and 120. Therefore, the electric field E becomes too strong at the spaces relative to the position of the small black solid image IGB that has conductivity. (The electric field E acts strongly in an insulating layer formed with the air.) Accordingly, the electric field E applied to the small black solid image IGB becomes too weak, thereby reducing the likelihood of occurrence of abnormal heating.

Figure 16:
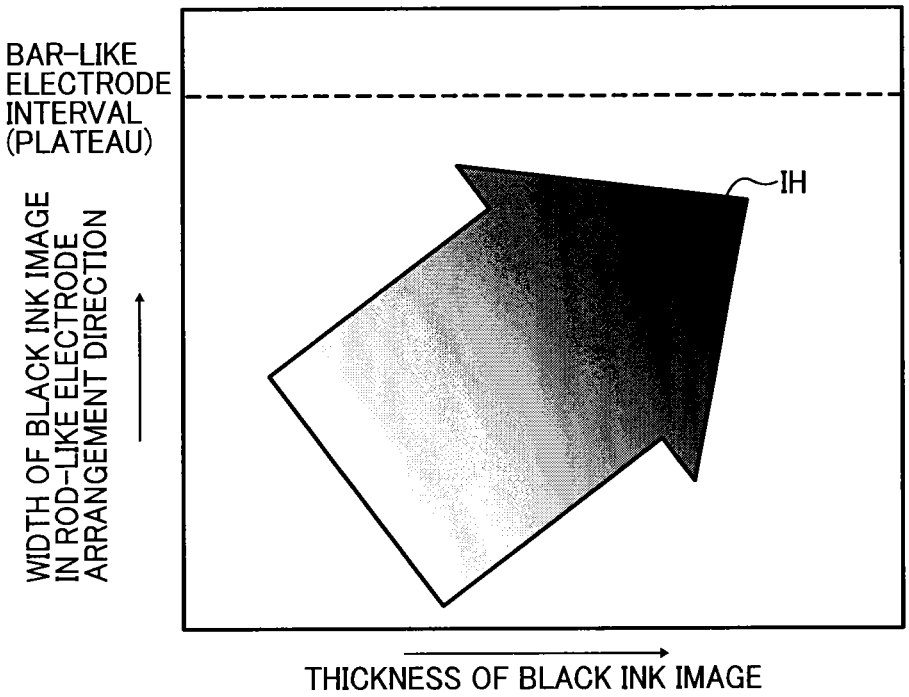
FIG. 16 is a diagram showing a relation between the thickness of a black ink image and the width of the black ink image in the arrangement direction of the rod-like electrodes.

FIG. 16 is a diagram showing a relation between the thickness of a black ink image and the width of the black ink image in the arrangement direction of the rod-like electrodes. FIG. 16 indicates that as the thickness of the black ink image increases, or the width thereof in the rod-like electrode arrangement direction increases, abnormal heating IH becomes more likely to occur. (The occurrence index IH becomes higher in the direction indicated by arrow in FIG. 16.) The thickness and width are formed into a matrix, to convert the likelihood of occurrence of abnormal heating into an index in accordance with the configuration of the black ink image. Prior to a drying of a print, an index is assigned to each black image part included in the print, and the highest index in the matrix is extracted. According to the extracted index, the drying output of the dielectric heater is lowered than the drying output which minimizes the amount of cockling. In addition, the drying output of the dielectric heater should be set so as not to cause image scorch. The deficient drying output is complemented by increasing the drying output of the uniform heater, as shown in FIG. 7. Thus, the drying operation is completed while preventing the occurrence of image scorch and maintaining a cockling suppressing effect although it is not optimum.

Figure 17:
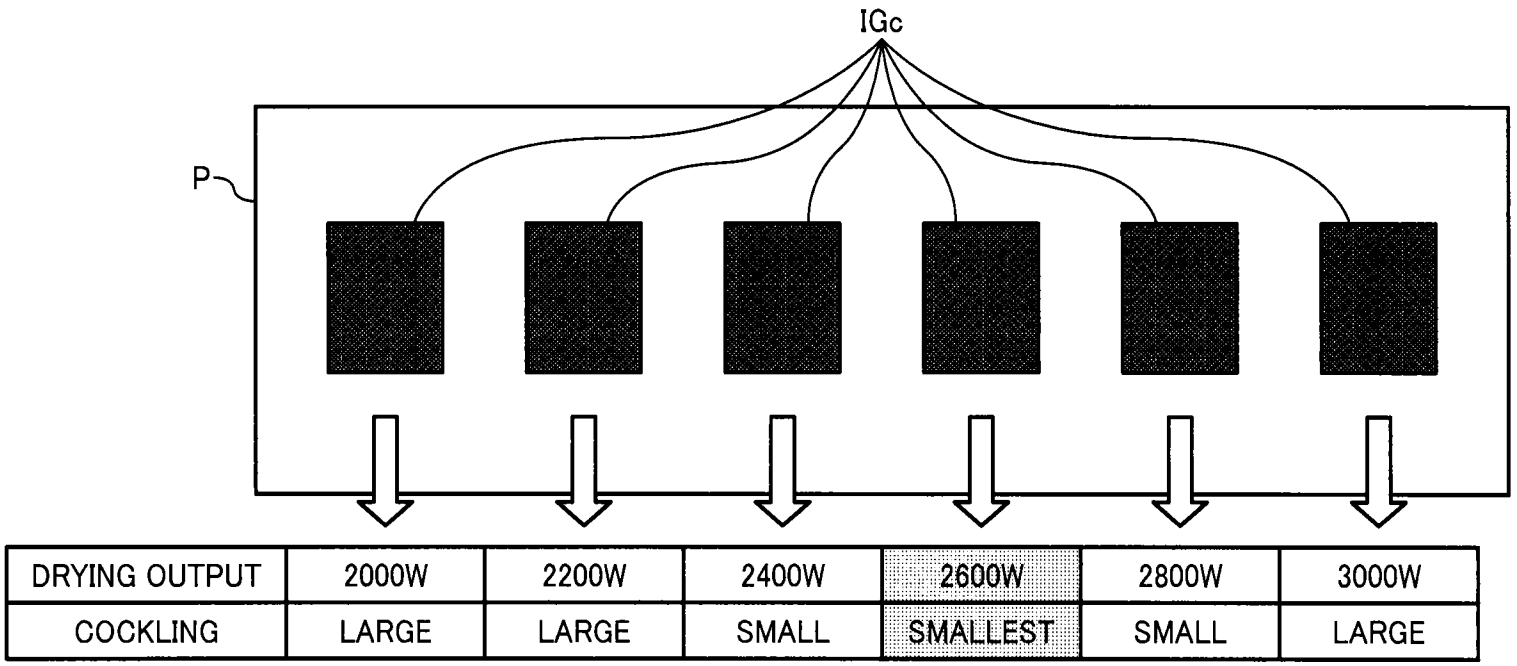
FIG. 17 is an illustration for explaining an operation procedure of the cockling condition detector 4.

How to operate the cockling condition detector 400 is described below with reference to FIG. 17. FIG. 17 is an illustration for explaining an operation procedure of the cockling condition detector 400. A purpose of introducing the cockling condition detector 400 is to specify the optimum drying output of the dielectric heater. Cockling is likely to occur in solid image. Since the output image is not always a solid image, and cockling needs a certain amount of time to grow, the drying output is preferably specified and set in an adjustment process of the apparatus. The adjustment process is performed at the time of starting the apparatus and at regular intervals.

In the adjustment process, as shown in FIG. 17, multiple solid pattern images IGc are formed on the paper medium P with an ink not containing conductive particle and subjected to a drying by the dielectric heater 100 while varying the drying output. At this time, the uniform heater 300 is not put into operation. Next, each of the solid pattern images IGc having been dried is subjected to a measurement by the cockling condition detector 400(400A). Thus, a drying output which minimizes the amount of cockling can be specified. In the example illustrated in FIG. 17, when the drying output of the dielectric heater 100 is 2,600 W, the amount of cockling becomes minimum (or equal to or less than a given amount). Therefore, the optimum drying output is 2,600 W in this case.

Since cockling needs a certain amount of time to grow, it is preferable that the images are guided to the cockling detecting position, let stand still, and then subjected to the measurement of the amount of cockling. By employing the drying output specified in the above-described manner, it is possible to create a condition in which heating by the dielectric heater 100 causes no cockling. Thus, the uniform heater 300 on a downstream side from the dielectric heater 100 can complete drying while the amount of cockling remained zero.

The optimum drying output of the dielectric heater 100, which minimizes the amount of cockling, varies depending on the type of paper medium and/or ink. Accordingly, the adjustment process is also performed when the type of paper medium and/or ink is changed. In addition, the optimum drying output is changed when the speed of feeding the paper medium is changed. For example, when the feeding speed is increased twice, the drying output may also be increased twice, based on the idea of proportional relation.

Figure 18:
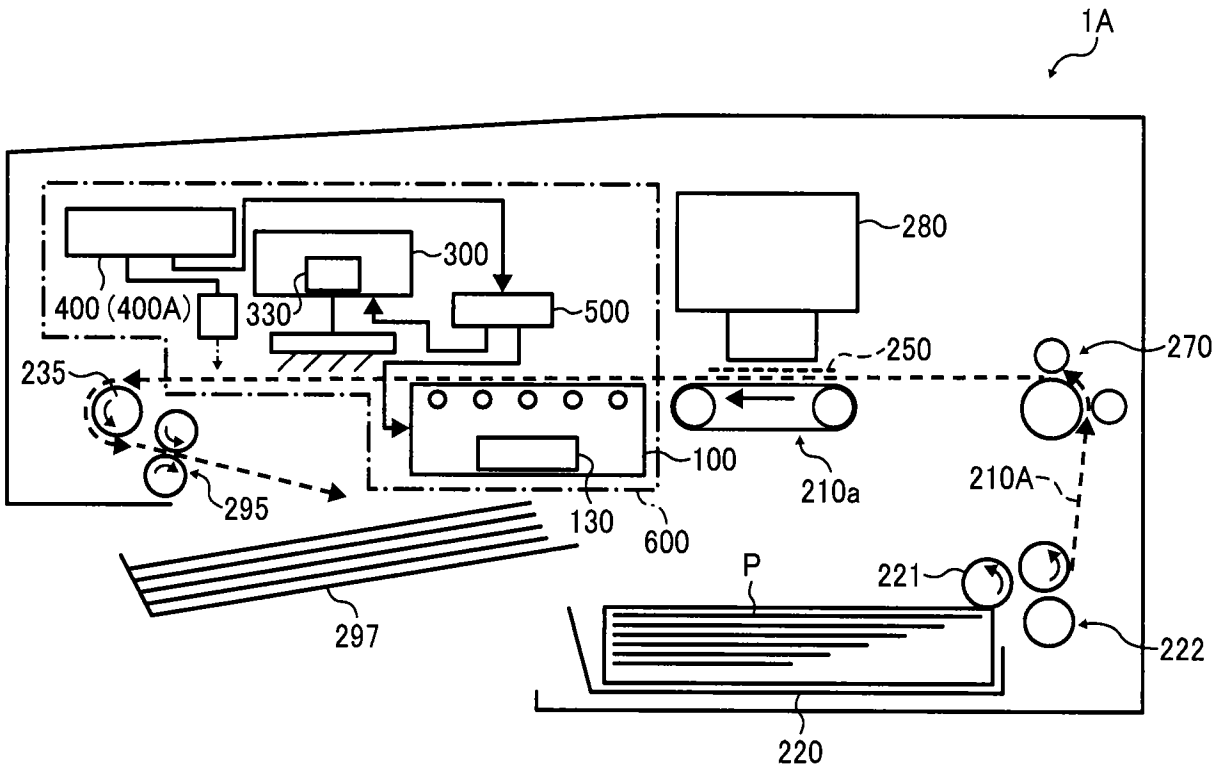
FIG. 18 is a schematic view of another inkjet image forming apparatus including the dryer in accordance with an embodiment of the present invention.

Another inkjet image forming apparatus 1A including the dryer 600 having the above-described drying mechanism is described below with reference to FIG. 18. FIG. 18 is a schematic view of an inkjet image forming apparatus 1A including the dryer 600 in accordance with an embodiment of the present invention.

The inkjet image forming apparatus 1A uses a recording medium in the form of a sheet. The inkjet image forming apparatus 1A has the same configuration as the inkjet image forming apparatus 1 illustrated in FIG. 12 except for the recording medium feeding mechanism.

The inkjet image forming apparatus 1A includes a sheet feeding tray 220, a sheet feeding roller 221, a separation roller pair 222, a medium feeding path 210A, a registration roller group 270, the medium feeding mechanism 210*a*, the inkjet head 280, the dryer 600, a folding roller 235, a sheet ejection roller pair 295, and a sheet ejection tray 297.

An operation of the inkjet image forming apparatus 1A is described below with reference to FIG. 18. The paper medium P, in the form of a sheet, stacked in the sheet feeding tray 220 is delivered one by one as the sheet feeding roller 221 rotates and subsequently the separation roller pair 222 cooperates. The paper medium P is fed to a nip portion of the registration roller group 270 via the medium feeding path 210A and allowed to temporarily stop at the nip portion. The paper medium P is then fed to the recording part 250 of the inkjet head 280 as the rollers of the registration roller group 270 rotate in synchronization with a driving timing of the inkjet head 280. On the paper medium P being fed by the medium feeding mechanism 210*a* while maintaining a planer form thereof, inks of multiple colors are sequentially discharged from multiples nozzles of the inkjet head 280. Thus, a desired ink image is formed on the paper medium P.

After the formation of the ink image, the paper medium P swelled by the ink image is subjected to a drying operation in the dryer 600 so that cockling is removed. The paper medium P having been dried is further fed by the folding roller 235 with the feeding direction changed, and ejected by the sheet ejection roller pair 295 to be stacked on the sheet ejection tray 297.

In accordance with some embodiments of the present invention, a dryer for drying an ink image formed on a recording medium (e.g., the recording medium P) is provided. The dryer includes a selective heating dryer (e.g., the dielectric heater 100), a uniform heating dryer (e.g., the uniform heater 300), and a controller (e.g., the controller 500). The selective heating dryer is disposed on an upstream side of a feeding path (e.g., the medium feeding path 210) of the recording medium, to perform a first-time drying of the ink image under an output condition in which an amount of cockling becomes equal to or less than a given amount. The uniform heating dryer is disposed on a downstream side from the selective heating dryer on the feeding path, to perform a second-time drying of the ink image after the selective heating dryer performs the first-time drying. The controller changes the output condition of the selective heating dryer in accordance with image information of the ink image, when the ink image is formed with a conductive-particle-containing ink (e.g., an ink containing conductive particles 20).

In accordance with some embodiments of the present invention, when the ink image includes an image pattern formed with the conductive-particle-containing ink, the controller decreases an output of the selective heating dryer and increases an output of the uniform heating dryer, to adjust a drying output through an entire drying including the first-time drying and the second-time drying.

According to this embodiment, the conductive-particle-containing ink image is prevented from scorching and the occurrence of cockling is suppressed as much as possible, thereby providing a reliable drying.

In accordance with some embodiments of the present invention, the above dryer further includes a cockling condition detector (e.g., the cockling condition detector 400) disposed on a downstream side from the selective heating dryer on the feeding path, to detect a cockling condition of the recording medium. During an initial adjustment process and a regular adjustment process in an operation of the dryer (e.g., the dryer 600), the controller causes the selective heating dryer to dry an ink image having a solid pattern formed with an ink not containing conductive particle on a recording medium, and correlates an output of the selective heating dryer with a detection result from the cockling condition detector, to determine the output condition of the selective heating dryer in which the amount of cockling becomes equal to or less than a given amount.

According to this embodiment, the optimum output of the selective heating dryer is obtainable.

In accordance with some embodiments of the present invention, the selective heating dryer employs a microwave or a high-frequency wave having a frequency in the range of 1 to 100 MHz to heat a high-dielectric-loss dielectric body alone.

According to this embodiment, the selective heating dryer heats the ink image part only without heating the recording medium, thereby controlling the occurrence of cockling.

In accordance with some embodiments of the present invention, the uniform heating dryer is a heater which approximately uniformly gives heat energy to an entire surface of the recording medium. The heater is selectable from a hot air heater, a heat drum, and a wideband infrared radiation heater.

According to this embodiment, the drying can be completed while maintaining the amount of cockling minimum.

In accordance with some embodiments of the present invention, an inkjet image forming apparatus (e.g., the inkjet image forming apparatus 1 or 1A) is provided. The inkjet image forming apparatus includes the inkjet head 280 that discharges an ink on a recording medium to form an ink image thereon and the dryer 600.

According to this embodiment, a printed material having a high image quality is provided.

In accordance with some embodiment of the present invention, the inkjet head 280 installed to the inkjet image forming apparatuses 1 and 1A includes all the known nozzle heads having an ink discharging mechanism. For example, the inkjet head 280 may be of a piezo type, a bubble-jet (registered trademark) type, or an electrostatic type, in terms actuator type.

In accordance with some embodiment of the present invention, the dryer 600 according to an embodiment of the present invention may be configured as a drying unit that is detachably mountable on a series of image forming apparatuses, a part of which is different from each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A dryer for drying an ink image formed on a recording medium, comprising:

a selective heating dryer disposed on an upstream side of a feeding path of the recording medium, to perform a first-time drying of the ink image under an output condition in which an amount of cockling becomes equal to or less than a given amount;

a uniform heating dryer disposed on a downstream side from the selective heating dryer on the feeding path, to perform a second-time drying of the ink image after the selective heating dryer performs the first-time drying; and a controller to change the output condition of the selective heating dryer in accordance with image information of the ink image, when the ink image is formed with a conductive-particle-containing ink.

2. The dryer according to claim 1, wherein, when the ink image includes an image pattern formed with the conductive-particle-containing ink, the controller decreases an output of the selective heating dryer and increases an output of the uniform heating dryer, to adjust a drying output through an entire drying including the first-time drying and the second-time drying.

3. The dryer according to claim 1, further comprising:

a cockling condition detector disposed on a downstream side from the selective heating dryer on the feeding path, to detect a cockling condition of the recording medium, wherein, during an initial adjustment process and a regular adjustment process in an operation of the dryer, the controller:

causes the selective heating dryer to dry an ink image having a solid pattern formed with an ink not containing conductive particle on a recording medium; and correlates an output of the selective heating dryer with a detection result from the cockling condition detector, to determine the output condition of the selective heating dryer in which the amount of cockling becomes equal to or less than a given amount.

4. The dryer according to claim 1, wherein the selective heating dryer employs a microwave or a high-frequency wave having a frequency in the range of 1 to 100 MHz to heat a high-dielectric-loss dielectric body alone.

5. The dryer according to claim 1, wherein the uniform heating dryer is a heater which approximately uniformly gives heat energy to an entire surface of the recording medium, the heater selectable from a hot air heater, a heat drum, and a wideband infrared radiation heater.

6. An inkjet image forming apparatus, comprising:

an inkjet head to discharge an ink on a recording medium; and the dryer according to claim 1.

* * * * *